US006991588B1

(12) United States Patent
Adams

(10) Patent No.: US 6,991,588 B1
(45) Date of Patent: Jan. 31, 2006

(54) STANDING SINGLE LEG PRESS EXERCISE MACHINE

(76) Inventor: Frederick R. Adams, 815 Alexander Valley Rd., Healdsburg, CA (US) 95448

( * ) Notice: Subject to any disclaimer, the term of this patent is extended or adjusted under 35 U.S.C. 154(b) by 393 days.

(21) Appl. No.: 10/346,821

(22) Filed: Jan. 18, 2003

(51) Int. Cl.
*A63B 22/00* (2006.01)

(52) U.S. Cl. ..... 482/71; 482/52; 601/34

(58) Field of Classification Search ..... 482/51, 482/52, 53, 79, 80, 74, 54, 55, 56, 93–96; 601/34, 35, 71
See application file for complete search history.

(56) References Cited

U.S. PATENT DOCUMENTS 4,900,012 A * 2/1990 Fu ..... 482/52
5,328,427 A * 7/1994 Sleamaker ..... 482/71
5,584,780 A * 12/1996 Lin ..... 482/51
6,702,724 B2 * 3/2004 Taylor et al. ..... 482/101

OTHER PUBLICATIONS

CADEx Fitness Systems LLC brochure for Standing Leg Press, 3 sheets. Obtained at a tradeshow in San Francisco in Feb. 2003.

* cited by examiner

*Primary Examiner*—Jerome W. Donnelly
(74) *Attorney, Agent, or Firm*—Jack Lo

(57) ABSTRACT

A standing single leg press exercise machine is comprised of a single movable step arranged to move up and down along an inclined path for exercising only one leg at a time. A resistance mechanism is connected to the movable step for providing resistance to movement. Two stationary steps are positioned on either side of the bottom position of the movable step. Hand rails are also positioned on either side of movable step. A shoulder pad is positioned above the movable step. A method for using the leg press is comprised of standing on one of the stationary steps with a stationary leg, and repeatedly operating the movable step up and down with an active leg. The active leg is exercised until it is tired, and the legs are switched to exercise the previously stationary leg while the previously active leg is rested.

6 Claims, 5 Drawing Sheets

STANDING SINGLE LEG PRESS EXERCISE MACHINE

BACKGROUND OF THE INVENTION

1. Field of the Invention

The invention broadly relates to exercise machines.

2. Prior Art:

A typical leg press exercise machine is comprised of a reclined bench for supporting a user, and a hinged weight carriage positioned for being pressed by both legs simultaneously. The upper body is generally perpendicular to the weight carriage. The user extends and retracts both legs to repeatedly press and release the weight carriage to lift and lower the weight. When the legs are fully extended, they are at a substantial angle relative to the upper body.

A problem with conventional leg presses is that the bent body position prevents the lower back and gluteal muscles from being properly exercised. Also, it is common for people to have a dominate leg, which will perform more work and maintain the imbalance between the legs. Using both legs together requires more weight to resist the strength of both legs. The seated position eliminates the body weight from the resistance, so that more weight is required. The main problem is that the body does not finish in a straight line, but instead is bent at all times.

Therefore, such machines do not provide the full range of motion necessary for proper exercising.

Two physiological limiting factors in exercising are the cardiovascular/aerobic threshold and anaerobic threshold. The cardiovascular threshold is the point of maximum possible heart rate, and the anaerobic threshold is the point of muscle failure. When exercising both legs together, a user may reach the cardiovascular threshold before the legs reach the anaerobic threshold.

BRIEF SUMMARY OF THE INVENTION

Accordingly, the objects of the invention are:

- to be used in a standing position;
- to exercise a single active leg while resting a stationary leg, thereby allowing the active leg to reach the anaerobic threshold while the user remains under the cardiovascular threshold;
- to align both legs with the body in a standing position when the active leg is fully extended so as to exercise the lower back;
- to enable a complete range of motion for exercising the gluteal muscles;
- to provide a range of leg motion that closely approximates natural movements such as running, jumping, and climbing;
- to stabilize the user; and
- to prevent the user's body from lifting when extending the active leg.

The standing single leg press exercise machine is comprised of a single movable step arranged to move up and down for exercising only one leg at a time. The movable step is guided by inclined guide bars to move along a slanted path. A resistance mechanism is connected to the movable step for providing resistance to movement. Two stationary steps are positioned on either side of the bottom position of the movable step. Hand rails are positioned on either side of movable step. A shoulder pad is positioned above the movable step. A method for using the leg press is comprised of standing on one of the stationary steps with a stationary leg straight, and an active leg on the movable step in a raised and bent position. The active leg is extended downward to depress the movable step against the resistance until the active leg is straight, and retracted upward against the resistance to return the movable step to its starting position. The extension and retraction are repeated until the active leg is tired, and the legs are switched to exercise the previously stationary leg while the previously active leg is resting. Since one leg is resting, the active leg is more capable of reaching the anaerobic threshold while the user remains under the cardiovascular threshold.

DRAWING REFERENCE NUMERALS

Figure 1:
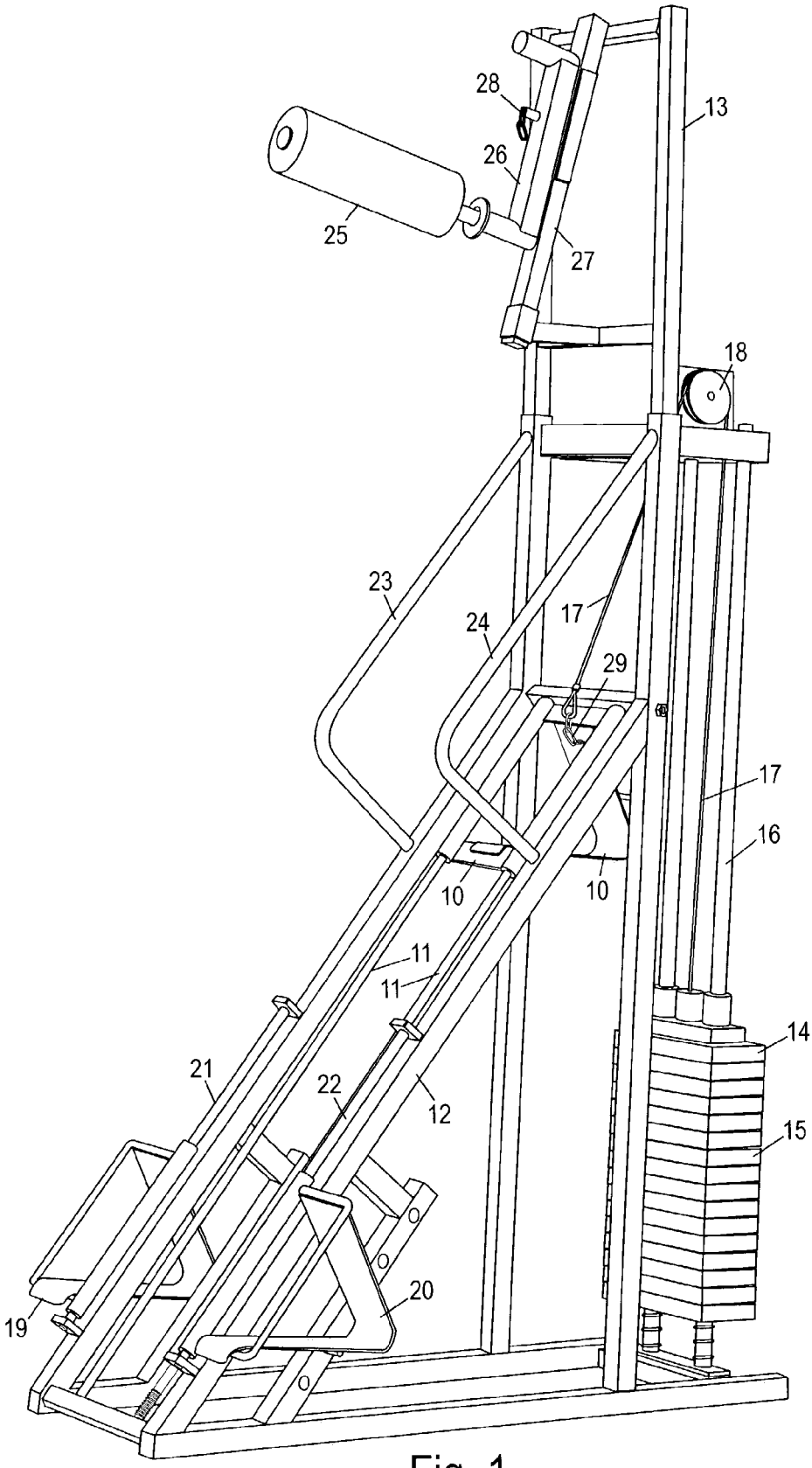
FIG. 1 is a perspective view of the standing single leg press exercise machine.

| | |
|---|---|
| 10. Movable Step | 11. Guide Bars |
| 12. Support Structure | 13. Vertical Portion |
| 14. Resistance Mechanism | 15. Weights |
| 16. Guide Bars | 17. Cable |
| 18. Pulley | 19. Stationary Step |
| 20. Stationary Step | 21. Guide Bar |
| 22. Guide Bar | 23. Hand Rail |
| 24. Hand Rail | 25. Shoulder Pad |
| 26. Bracket | 27. Guide Bar |
| 28. Pin | 29. Chain |

DETAILED DESCRIPTION OF THE INVENTION

FIG. 1:

A preferred embodiment of the standing single leg press exercise machine is comprised of only a single movable step 10 arranged to move up and down for exercising only one leg at a time. Movable step 10 is shown in a resting position at a top end of its movement range. Movable step 10 is preferably guided by inclined movable step guide bars 11 to move along a slanted path positioned at about 37 degrees from vertical for optimal benefit, but other angles are also possible. Also, guide bars 11 may be curved instead of straight. Movable step guide bars 11 are supported by a generally triangular support structure 12 with an upwardly projecting vertical portion 13.

A resistance mechanism 14 is connected to movable step 10 for providing resistance to movement. In this example, resistance mechanism 14 is comprised of a stack of weights 15 arranged to move along vertical weight guide bars 16 in support structure 12, and connected to movable step 10 by a cable 17 which is wrapped around a pulley 18 attached to support structure 12 above weights 15 and movable step 10. The number of weights 15 connected to cable 17 may be user selectable with the same type of mechanism (not shown) used in prior art weight training machines for adjusting the resistance. Alternatively, weight guide bars may be slanted or curved, and other types of resistance mechanisms may be provided, such as springs, elastic bands, hydraulic cylinders, electromagnets, etc.

Two stationary steps 19 and 20 are positioned on either side of movable step 10 adjacent a bottom end of its movement range, preferably by being attached to opposite sides of support structure 12. Stationary steps 19 and 20 are preferably attached to stationary step guide bars 21 and 22 that are parallel to movable step guide bar, so that steps 19 and 20 are adjustable up and down along stationary step guide bars 21 and 22, and are lockable in selected positions, such as by pins (not shown), for users of different heights. Alternatively, stationary steps 19 and 20 may be fixed in height.

Hand rails 23 and 24 are positioned on either side of movable step 10 adjacent the top end of its movement range, preferably by being attached to the top of support structure 12. A generally horizontal shoulder pad 25 is positioned above movable step 10, preferably by being attached to vertical portion 13 of support structure 12. Shoulder pad 25 is attached to a bracket 26 which is movable along a shoulder pad guide bar 27 attached to vertical portion 13, and is lockable in position by a pin 28 positioned through bracket 26 and shoulder pad guide bar 27. In this example, a single shoulder pad 25 is shown along the median plane of the leg press, but two parallel shoulder pads offset from the median plane may also be provided.

FIGS. 2–5:

The leg press is used for exercising the legs one at a time with a selected amount of resistance suitable for the user. A method for exercising the right leg is shown in FIGS. 2–4.

Figure 2:
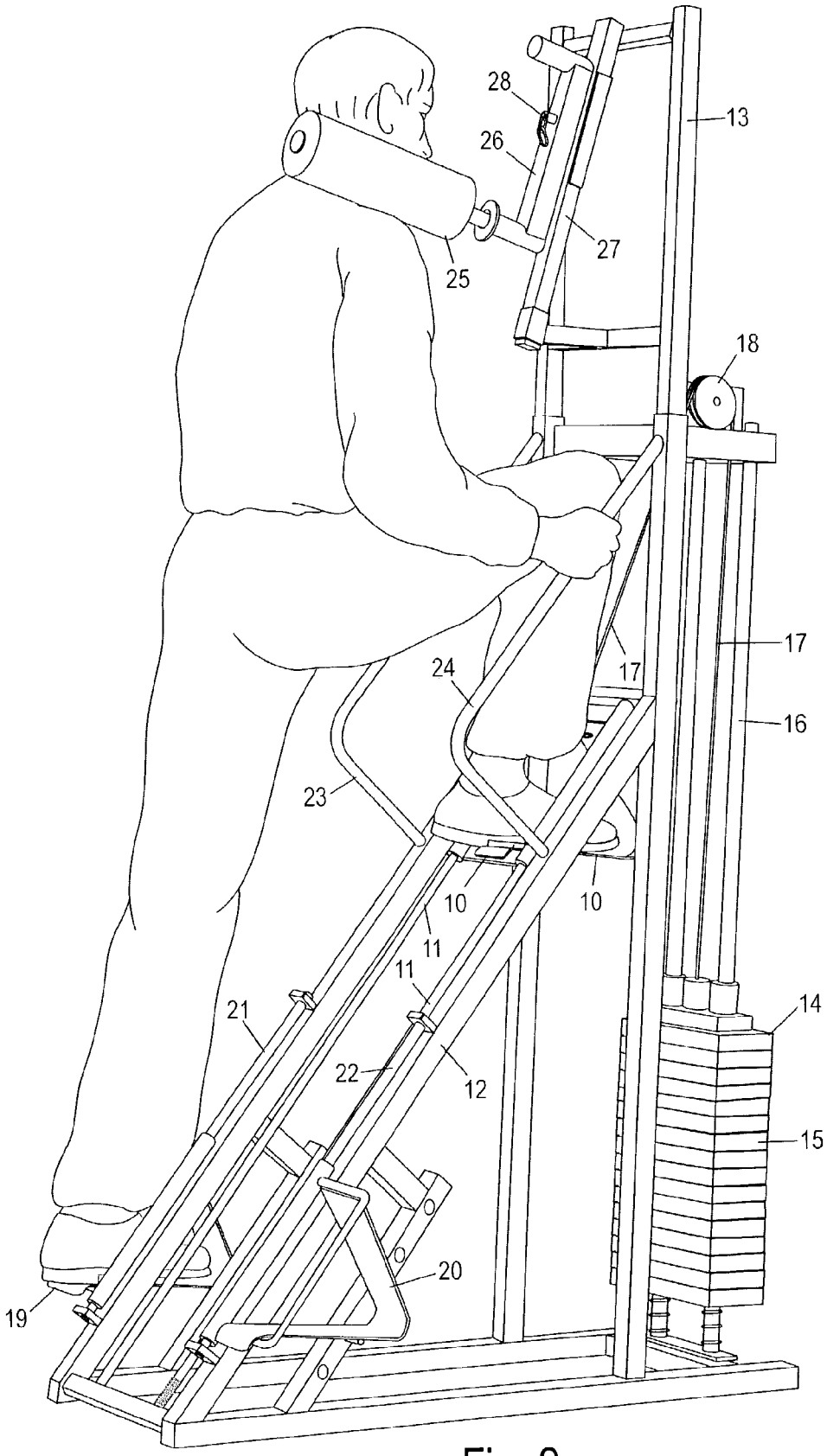
FIG. 2 shows a user in a starting position for exercising the right leg, wherein the right leg raised and bent.

In FIG. 2, the user is standing on left stationary step 19 with the left or stationary leg straight, and the right or active leg on movable step 10 in a raised and bent starting position. Stationary steps 19 and 20 are adjusted in height so that when movable step 10 is at the top position, the upper part of the active leg is generally horizontal, and the lower part of the active leg is generally vertical. Movable step 10 may be adjusted in height by being connected to different links on a chain 29 which is connected to cable 17. The hands are gripped around handrails 23 and 24 for stability. Shoulder pad 25 is adjusted in height to engage the shoulder on the same side as the active leg to prevent the user's body from lifting.

Figure 3:
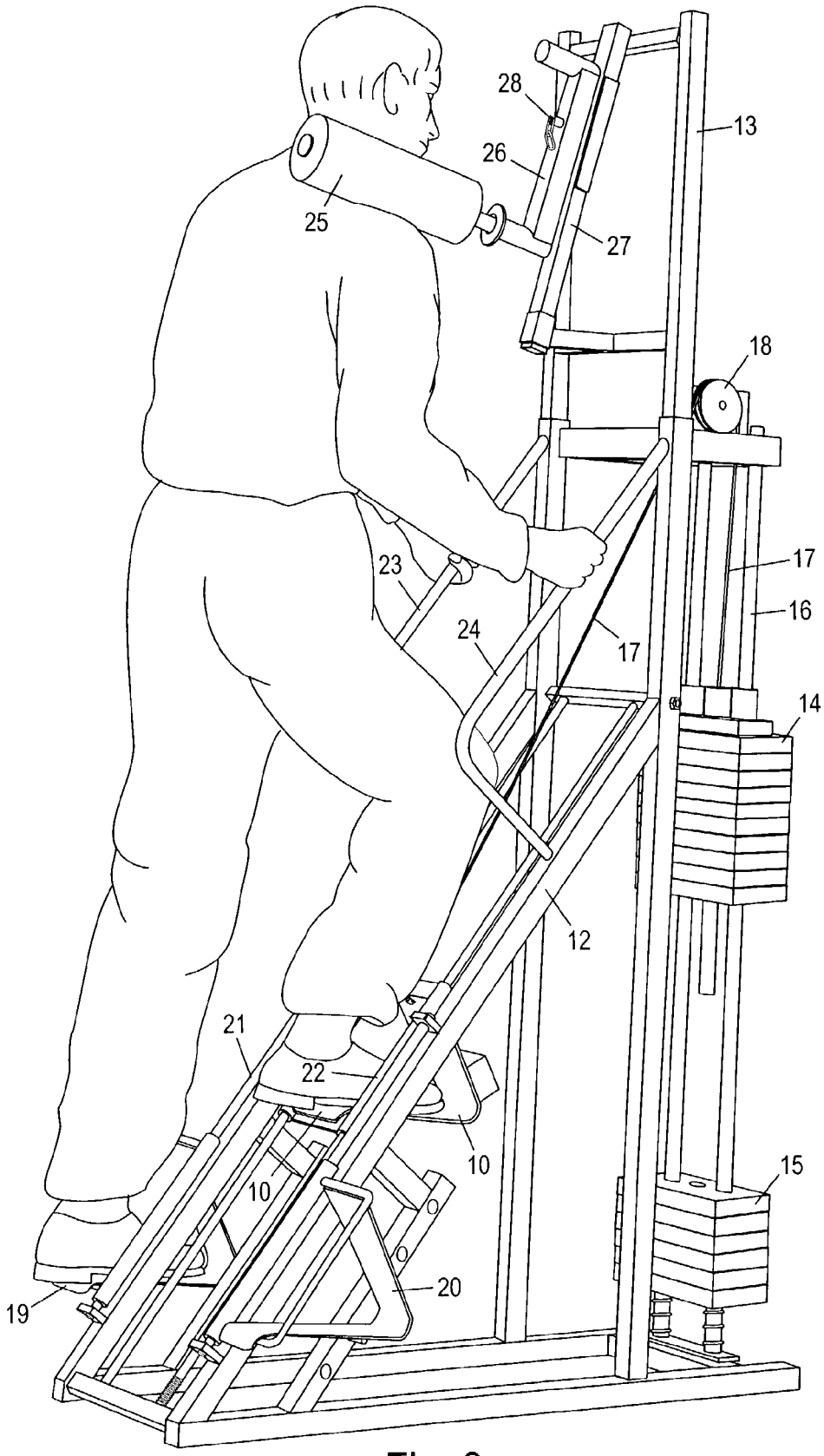
FIG. 3 shows the user with the right leg partially extended.
Figure 4:
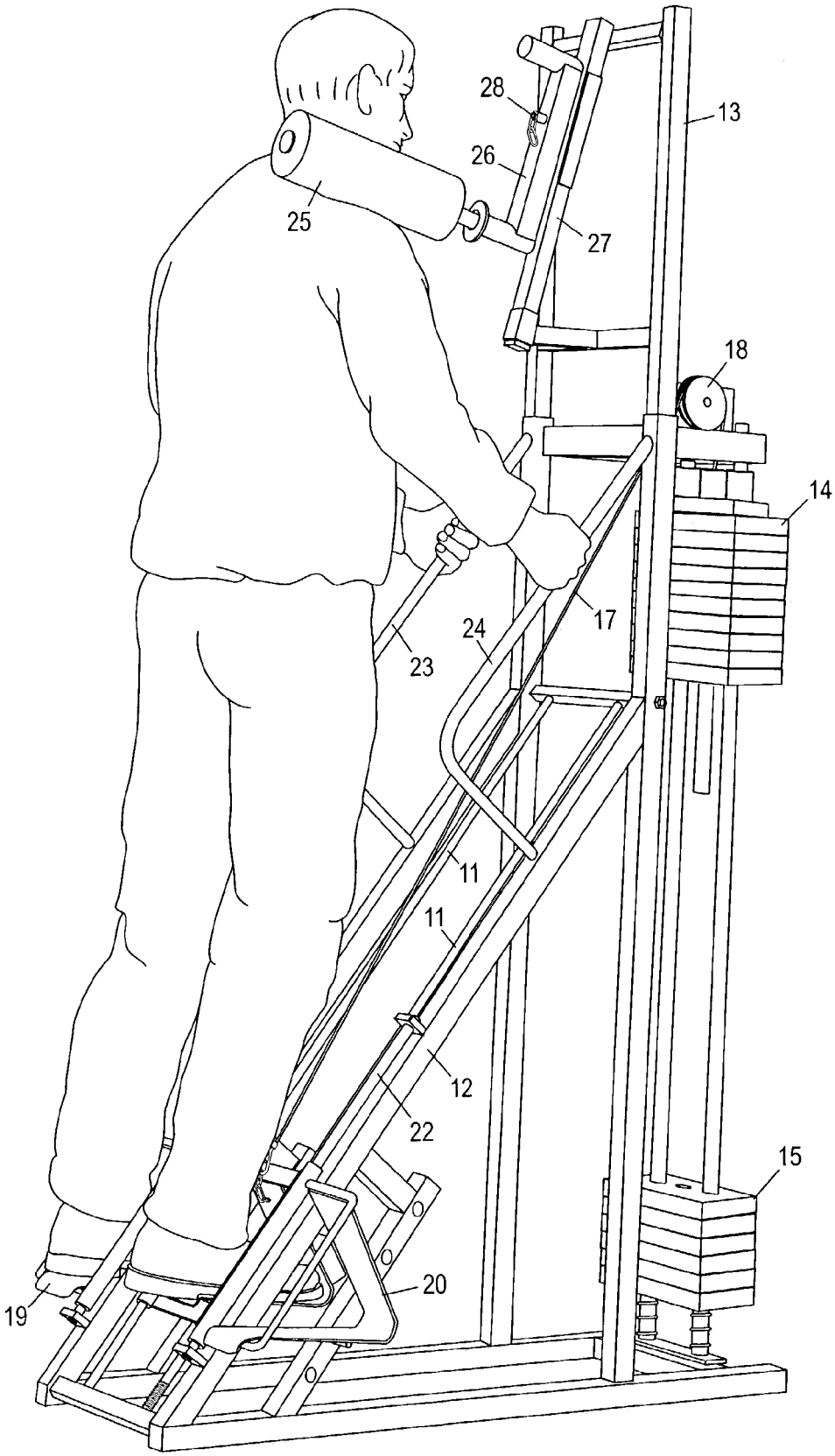
FIG. 4 shows the user with the right leg fully extended.

In FIGS. 3–4, the active leg is extended downward to depress movable step 10 against the resistance provided by resistance mechanism 14 until the active leg is straight and aligned with the upper body. The bottom position of movable step 10 is generally aligned with stationary steps 19 and 20, as shown in FIG. 4. The active leg is retracted upward against the resistance to return movable step 10 to its top position. Each cycle of extension and retraction is a repetition. Moving the active leg from a bent position to a straight position aligned with the upper body most closely approximates natural motions such as running, jumping, or climbing uphill. The standing position also exercises the lower back and gluteal muscles more completely. Additional repetitions are performed until the active leg is tired, and the legs are switched to exercise the previously stationary leg. Anyone with a dominant or stronger leg can exercise the weaker leg appropriately to achieve symmetry.

Figure 5:
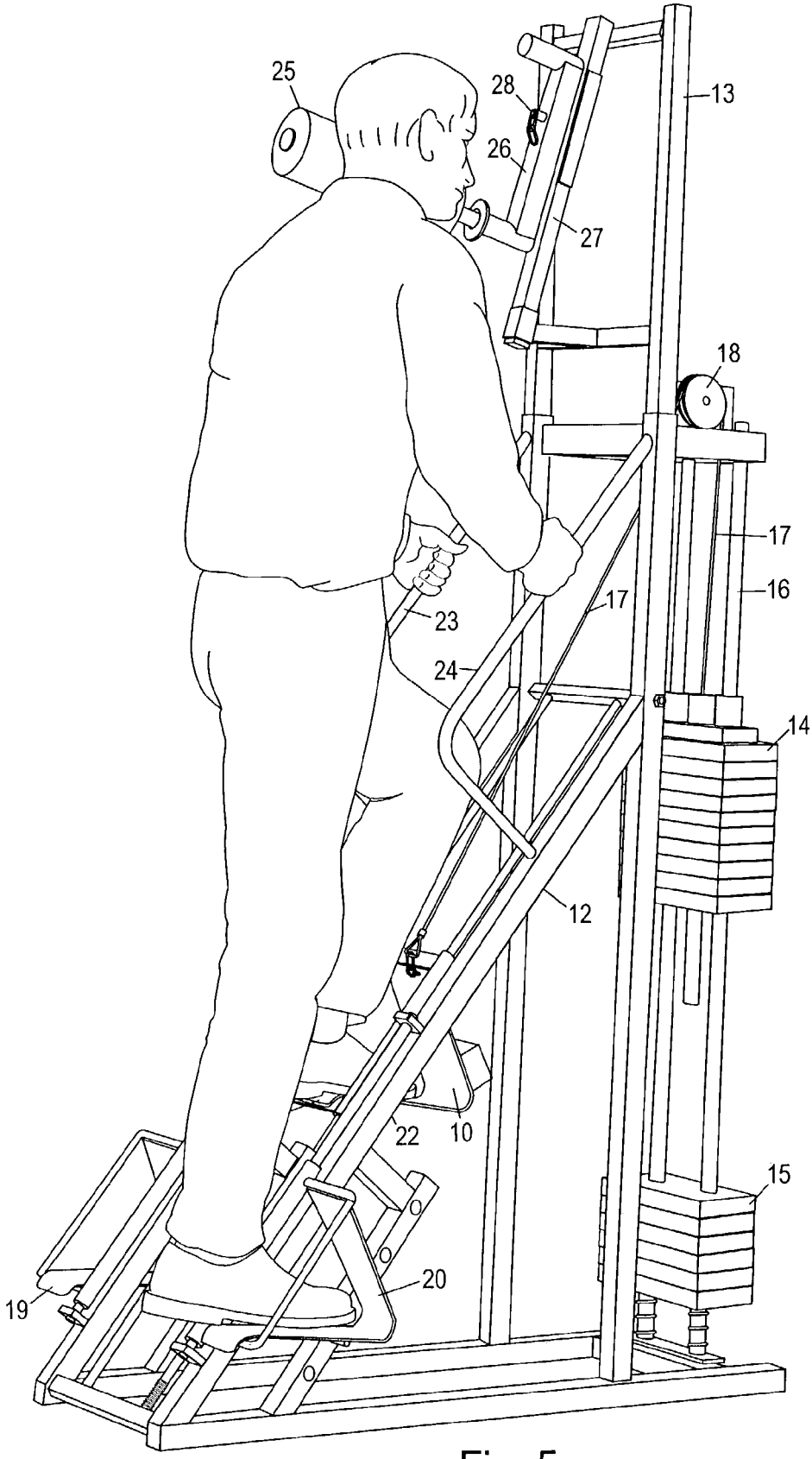
FIG. 5 shows the user exercising the left leg.

In FIG. 5, the right leg is positioned on right stationary step 20 and becomes the stationary leg. The left leg is positioned on movable step 10 and becomes the active leg. Since the stationary leg is resting while the active leg is exercising, the active leg is more capable of reaching the anaerobic threshold while the user remains under the cardiovascular threshold.

An exemplar training method is comprised of performing 10–15 repetitions with one leg until anaerobic failure with the maximum possible resistance for the user's capacity, then switch legs until anaerobic failure. The user may perform 2 or 3 sets or cycles. Another possible training method is to select a resistance about 20% below the user's maximum capacity, perform 20–30 repetitions with each leg and intermingle several upper body exercises, repeat the leg training, then again return to the upper body exercises. Alternating between lower and upper body exercises allows alternate parts of the body to rest while the other part is being exercised, so that greater resistance can be used. Another possible training method is to select a resistance about 20% below the user's capacity, and alternately perform 20–30 repetitions with each leg for an extended period.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. A standing single leg press exercise machine, comprising:

only a single movable step arranged to move up and down for exercising only one leg at a time while the other leg is stationary, wherein said movable step has a movement range defined between a top position and a bottom position;

a resistance mechanism connected to said movable step for providing resistance; and two stationary steps positioned on either side of said movable step adjacent said bottom position of said movable step.

2. The standing single leg press exercise machine of claim 1, wherein said movable step is arranged to move along a path slanted at about 37 degrees from vertical.

3. The standing single leg press exercise machine of claim 1, wherein said movable step arranged to slide along a slanted guide bar.

4. The standing single leg press exercise machine of claim 1, further including hand rails positioned on either side of movable step.

5. The standing single leg press exercise machine of claim 1, further including a generally horizontal shoulder pad positioned above said movable step for engaging a shoulder.

6. The standing single leg press exercise machine of claim 1, further including hand rails positioned on either side of movable step, and a shoulder pad positioned above said movable step for engaging a shoulder.

* * * * *